United States Patent [19]

Miyata et al.

[11] Patent Number: 4,524,256

[45] Date of Patent: Jun. 18, 1985

[54] PRESSURE-SENSITIVE ELEMENT

[75] Inventors: Hiroyasu Miyata; Kazuhiko Ito, both of Furukawa, Japan

[73] Assignee: Alps Electric Co., Ltd., Japan

[21] Appl. No.: 527,286

[22] Filed: Aug. 29, 1983

[30] Foreign Application Priority Data

Aug. 27, 1982 [JP] Japan ..... 57-128542[U]

[51] Int. Cl.[3] ..... H01H 35/00

[52] U.S. Cl. ..... 200/86 R; 200/85 R; 200/159 B

[58] Field of Search ..... 200/85 R, 86 R, 86.5, 200/159 B, 333, 61.19, 275, 279

[56] References Cited

U.S. PATENT DOCUMENTS

| | | | |
|---|---|---|---|
| Re. 28,365 | 3/1975 | Brave | 200/159 B X |
| 3,668,337 | 6/1972 | Sinclair | 200/86.5 X |
| 3,920,940 | 11/1975 | Brown et al. | 200/85 R X |
| 4,296,406 | 10/1981 | Pearson | 340/166 R |
| 4,317,012 | 2/1982 | Itoh | 200/5 A |

*Primary Examiner*—G. P. Tolin

*Attorney, Agent, or Firm*—Guy W. Shoup

[57] ABSTRACT

A pressure-sensitive element for use in a keyboard switch etc., comprising a conductive porous material which is rugged, an elastic insulator which bulges more than convex parts of the conductive porous material without covering the convex parts, and a conductive layer which opposes to the conductive porous material through the elastic insulator. When no pressure is applied, openings are formed between the convex parts of the conductive porous material and the conductive layer through the elastic insulator, whereby the pressure-sensitive element is in its nonconductive state. When a pressure is applied, the elastic insulator is deformed to bring the convex part of the conductive porous material into contact with the conductive layer, whereby the pressure-sensitive element is brought into its conductive state.

3 Claims, 5 Drawing Figures

PRESSURE-SENSITIVE ELEMENT

BACKGROUND OF THE INVENTION

The present invention relates to a pressure-sensitive element which is used as, for example, the switching element of a keyboard switch. More particularly, it relates to a pressure-sensitive element whose resistance value is varied stably and with good reproducibility by a pressure.

A prior-art pressure-sensitive element has been such that electrically-conductive particles are dispersed in an electrically-insulating elastic material such as rubber. The conduction mechanism of this pressure-sensitive element is as stated below. When the pressure-sensitive element is compressed by applying a pressure thereto, the conductive particles dispersed in the elastic material come into contact with one another, to form a conduction path. In addition, when the applied pressure is removed, the conductive particles return into the dispersed state, to restore the electrically-insulated state. In general, the pressure-sensitive element has a varying resistance range from an insulating state of a resistivity higher than $10^7$ Ωcm, to a conductive state of a resistivity lower than $10^3$ Ωcm.

The resistance variation of the prior-art pressure-sensitive element depends upon the approach and contact of the conductive particles in the pressed part. This leads to the disadvantages that the resistance value versus the pressure disperses greatly and that the reproducibility is poor.

SUMMARY OF THE INVENTION

An object of the present invention is to eliminate the disadvantages of the prior art described above, and to provide a pressure-sensitive element whose resistance value is varied stably and with good reproducibility by a pressure.

In order to accomplish the object, according to the present invention, a pressure-sensitive element comprises a conductive porous material which is rugged, an elastic insulator which bulges more than convex parts of said conductive porous material without covering said convex parts, and a conductive layer which opposes to said conductive porous material through said elastic insulator; so that when no pressure is applied, openings are formed between said convex parts of said conductive porous material and said conductive layer through said elastic insulator, whereby said element is in its nonconductive state, and that when a pressure is applied, said elastic insulator is deformed to bring said convex part of said conductive porous material into contact with said conductive layer, whereby said element falls into its conductive state.

PREFERRED EMBODIMENT OF THE INVENTION

Figure 1:
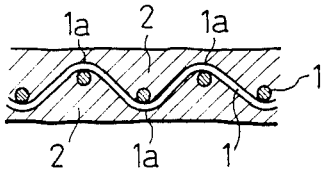
FIGS. 1, 2 and 3 are sectional views for explaining the manufacturing process of a pressure-sensitive element according to the present invention.
Figure 2:
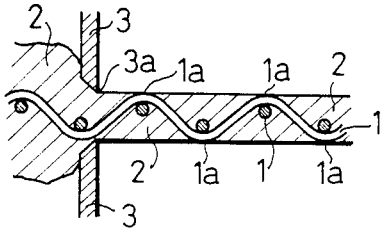
Figure 3:
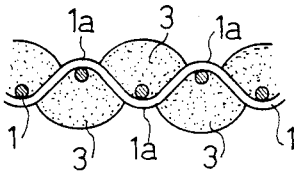

Now, an embodiment of the present invention will be described with reference to the drawings. FIGS. 1 to 3 are views for explaining a manufacturing process. Numeral 1 designates a conductive porous material which is rugged. Concretely, it is a net of approximately 150 meshes to 250 meshes. This net 1 is made of a copper-zinc alloy, phosphor bronze as it is or plated with gold, stainless steel, or the like. The wire diameter of the net 1 is about 40μ, and the height (thickness) between the upper and lower convex parts 1*a* of this net is about 100μ. Both the upper and lower surfaces of the conductive porous material 1 are coated with an unfoamed resin 2 to the extent that the respective convex parts 1*a* are covered as shown in FIG. 1. At the next step, the conductive porous material 1 coated with the unfoamed resin 2 is passed through the hole 3*a* of a knife 3, the hole having a length substantially equal to the height of the conductive porous material 1. Then, as shown in FIG. 2, the excessive resin 2 is shaved away by the knife 3, so that the convex parts 1*a* of the conductive porous material 1 are exposed. Subsequently, when the unfoamed resin 2 is heated and foamed, it comes to bulge more than the convex parts 1*a* and forms an elastic insulator 3 as shown in FIG. 3. The elastic insulator 3 should favorably consist of independent foams excellent in the elastic force and the restoring force, and the elastic force as desired can be attained by changing foaming conditions.

Figure 4:
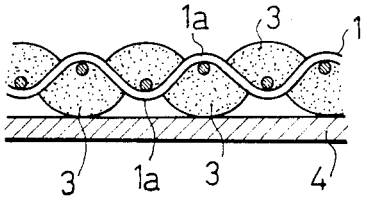
FIG. 4 is a sectional view of the pressure-sensitive element according to the present invention with no pressure applied thereto.

The conductive porous material 1 is electrically connected with one electrode. In addition, a conductive layer 4 which is the other electrode is arranged under the elastic insulator 3 as shown in FIG. 4. This figure illustrates a state in which no pressure is applied. Openings are formed between the convex parts 1*a* of the conductive porous material 1 and the conductive layer 4 owing to the intervention of the elastic insulator 3. Accordingly, the conductive porous material 1 and the conductive layer 4 are out of contact, to hold an insulated state.

Figure 5:
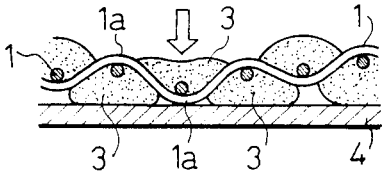
FIG. 5 is a sectional view of the pressure-sensitive element with a pressure applied thereto.

When the upper layer of elastic insulator 3 is depressed toward the conductive layer 4, the elastic insulator 3 in the vicinity of the depressed part is deformed, and the convex part 1*a* of the conductive porous material 1 approaches the conductive layer 4 gradually. Upon further depression, the convex part 1*a* comes into contact with the conductive layer 4 as shown in FIG. 5. Thus, both the electrodes, in other words, the conductive porous material 1 and the conductive layer 4 fall into a conductive state.

When the pressure applied to the elastic insulator 3 is released, the conductive porous material 1 and the elastic insulator 3 undergo quite the reverse phenomenon to the foregoing, and the conductive porous material 1 and the conductive layer 4 return into the insulated state. This returning operation, namely, the resetting operation of the pressure-sensitive element is maintained for a long time owing to the flexibility of the net being the conductive porous material 1 and the foaming property of the elastic insulator 3. The element therefore becomes rich in reproducibility.

As the conductive porous material 1, the net explained in the embodiment can be replaced with an expanded metal.

The present invention is constructed as described above. Owing to such construction, it can provide a pressure-sensitive element whose resistance value versus a pressure disperses little and is of good reproducibility.

The pressure-sensitive element of the present invention can be used as a keyboard switch etc. and also as switching elements furnished with the functions of dust-proof, water-proof, gastightness, etc.

We claim:

1. A pressure-sensitive element comprising a conductive process mesh having a plurality of spaced-apart convex conductive parts, an elastic insulator formed integrally with said mesh having a plurality of spaced-apart insulator parts between adjacent convex conductive parts which bulge more than said convex conductive parts without covering said convex conductive parts, and a conductive layer opposed to said conductive porous mesh and elastic insulator; so that when no pressure is applied, said convex conductive parts of said conductive porous mesh are spaced apart from said conductive layer by the bulging of said insulator parts of said elastic insulator, whereby said element is in its nonconductive state, and that when a pressure is applied, the bulging of said insulator parts of said elastic insulator is deformed to bring at least one of said convex conductive parts of said conductive porous mesh into contact with said conductive layer, whereby said element is in its conductive state.

2. A pressure-sensitive element according to claim 1, wherein said elastic insulator is an insulating formed material.

3. A pressure-sensitive element according to claim 1, wherein said conductive porous mesh is a metallic net of approximately 150 meshes to approximately 250 meshes.

* * * * *